US007619401B2

(12) United States Patent
Chen et al.

(10) Patent No.: US 7,619,401 B2
(45) Date of Patent: Nov. 17, 2009

(54) BANDGAP REFERENCE CIRCUIT

(75) Inventors: An-Chung Chen, Zhu-Bei (TW); Hung-Cheng Huang, Taipei (TW); Wen-Lung Cheng, Taipei (TW); Ming-Tse Lin, SanChong (TW)

(73) Assignee: NVIDIA Corporation, Santa Clara, CA (US)

( * ) Notice: Subject to any disclaimer, the term of this patent is extended or adjusted under 35 U.S.C. 154(b) by 1 day.

(21) Appl. No.: 11/781,904

(22) Filed: Jul. 23, 2007

(65) Prior Publication Data

US 2008/0018317 A1 Jan. 24, 2008

Related U.S. Application Data

(63) Continuation of application No. 11/447,124, filed on Jun. 6, 2006, now Pat. No. 7,253,599.

(30) Foreign Application Priority Data

Jun. 10, 2005 (TW) ..... 94119343 A

(51) Int. Cl.
*G05F 3/28* (2006.01)
*G05F 3/20* (2006.01)

(52) U.S. Cl. ..... 323/316; 323/314

(58) Field of Classification Search ..... 323/268, 323/269, 275, 311–316
See application file for complete search history.

(56) References Cited

U.S. PATENT DOCUMENTS

| | | | | |
|---|---|---|---|---|
| 6,191,644 | B1 | 2/2001 | Srinath et al. | |
| 6,242,897 | B1 * | 6/2001 | Savage et al. | 323/313 |
| 6,531,857 | B2 | 3/2003 | Ju | |
| 6,788,041 | B2 | 9/2004 | Gheorghe et al. | |
| 7,071,767 | B2 * | 7/2006 | Ou-yang et al. | 327/539 |
| 7,253,597 | B2 * | 8/2007 | Brokaw | 323/314 |

* cited by examiner

*Primary Examiner*—Gary L Laxton
(74) *Attorney, Agent, or Firm*—Patterson & Sheridan, LLP

(57) ABSTRACT

A bandgap reference circuit having a low sensitivity to temperature and supplied voltage installs a compensation circuit on a bandgap reference circuit to substitute a prior art that uses a resistor to match the circuit startup purpose and solve the problem of startup error caused by the manufacturing error. The bandgap reference circuit includes a first amplifier, a second amplifier, and a reference circuit having a plurality of transistors and a plurality of bipolar junction transistors, and the bandgap reference circuit is electrically connected to a same supplied power of which the reference circuit is electrically connected and also includes a plurality of transistors and a compensation circuit of the second amplifier, so as to output a stable startup voltage which has a low sensitivity to the change of temperature and the change of supplied voltage.

8 Claims, 5 Drawing Sheets

BANDGAP REFERENCE CIRCUIT

CROSS-REFERENCE TO RELATED APPLICATIONS

This application is a continuation application of, and claims priority benefit to, U.S. patent application Ser. No. 11/447,124, filed Jun. 6, 2006 now U.S. Pat. No. 7,253,599, which claims priority to Taiwan Application No. 94119343, filed Jun. 10, 2005, and is hereby incorporated by reference herein.

BACKGROUND OF THE INVENTION

1. Field of the Invention

The present invention relates to a bandgap reference circuit, and more particularly to a bandgap reference circuit that produces a low sensitivity to the change of temperature and the change of supplied voltage to provide a more stable startup mechanism.

2. Description of Related Art

In the topic of a general bandgap reference voltage, a transistor produces a voltage drop by the positive voltage of a base-emitter voltage (VBE) of a PN junction and adopts the characteristic of the base-emitter voltage being proportional to absolute temperature (PTAT) to produce a reference voltage used for starting up a circuit.

A prior art bandgap reference circuit as disclosed in U.S. Pat. No. 6,788,041 provides a low-power bandgap circuit that produces a reference voltage, and the bandgap circuit comprises a transistor, a bias voltage circuit for producing a bias voltage current, a PTAT current source, and a resistor to provide a low-power and accurate reference voltage, wherein the appropriate resistance of the resistor and the PTAT current can maintain the stability of the current and reduce the sensitivity to temperature. Another prior art as disclosed in U.S. Pat. No. 6,531,857 comprises a plurality of transistors and a low-voltage bandgap reference circuit of the operational amplifiers, or uses a startup circuit to implement the bandgap reference circuit. In U.S. Pat. No. 6,191,644, a better startup circuit is provided, and the present invention further provides a solution for stabilizing voltage and overcomes the shortcomings of a prior art that produces errors during the startup of a circuit.

In FIG. 1, a prior art bandgap circuit comprises identical and gate junction P-type metal oxide semiconductors (PMOS) P1, P2, P3, and a P-type metal oxide semiconductor P1 forming a current mirror transistor of the P-type metal oxide semiconductor P2, P3, and the gates of these three transistors are connected to an input terminal of the operational amplifier OP1, and thus the P-type metal oxide semiconductors P1, P2, P3 have the same drain currents. In other words, I1=I2=I3. In addition, a PNP type bipolar junction transistor (BJT) Q1, Q2 connects its emitter to a drain of the transistor P1, P2 to form a structure similar to a diode, and the emitter area of PNP-type bipolar junction transistor Q2 is an integer multiple N of the emitter area of the transistor Q1.

Further, the control of the same voltage Va, Vb of the input terminal of the operational amplifier OP1 is the same as the drain voltage Va=Vb of the metal oxide semiconductor P1, P2. Since the resistors R1, R2 (R1+R2) having the same characteristics forms a current VBE/R1 passing through the structure, and the base-emitter voltage VBE is inversely proportional to temperature T, wherein the VBE is the base-emitter voltage of the bipolar junction transistors. Since Voltages Va=Vb and the current passing through the resistor R3 is proportional to absolute temperature (PTAT), therefore the PTAT current is equal to VT·1 nN/R3, wherein the VT equals to KT/q, V is the value of voltage, T is the value of absolute temperature value, N is a ratio of emitter areas of the bipolar junction transistors Q2, Q, K is Boltzmann constant, and q is the value of electric charges (in the unit of Coulomb).

The current I2 passing through the transistor P2 is equal to the sum of the current I2 passing through the resistor R2 (=VBE/R1) and the current passing through the resistor R3 (VBE/R3=VT·1 nN/R3), and $$I2=(\mathrm{VBE}/R1)+(VT\cdot 1\ nN/R3)$$

and since I1=I2=I3, therefore reference voltage Vref=R4·I3=R4·I2, Therefore, $$\mathrm{Vref}=R4\cdot((\mathrm{VBE}/R1)+(VT\cdot 1\ nN/R3))$$

Since Vref=(R4/R3)·((VBE·R3/R1)+(*VT*·1 nN))

From this formula, if the ratio R3/R1 is an optimum of N, then the reference voltage Vref can produce a low sensitivity to the temperature and supplied voltage.

However, there may be manufacturing errors in the resistors R1, R2, the deviation produced by the operational amplifier OP1 will produce a deviated output of the reference voltage Vref, which will be affected by temperature. More seriously, the manufacturing errors of the resistors R1, R2 of the drains of the transistors P1, P2 will cause an error to the startup of a circuit.

Reference is made to FIG. 2 for the schematic view of the changes of input voltage and output voltage, when the input terminal of the operational amplifier is disconnected with the metal oxide semiconductors P1, P2, P3. In FIG. 2, the inclined straight line shows an output voltage of the operational amplifier OP1 measured when the stable testing voltage is inputted, and the curved line shows a waveform of the voltage when the transistors P1, P2, P3 are disconnected. Three voltage solutions (a, b, c) are observed, and the section (a, b) of the two voltages dropping drastically indicates the value of voltage causing an error to the startup of the circuit, and the point c indicates the value of voltage having a correct startup of circuit. The change of errors of the resistors R1, R2 is shown by the drastic descending waveform between Points a and b. In other words, if the resistor R1 is equal to R2, then the error of the startup of the circuit will not occur.

To overcome the error of the prior art startup circuit caused by the errors of the resistors R1, R2, the present invention provides a more stable startup mechanism to give a better bandgap reference circuit and neglect the errors caused by the resistors, so that the output voltage will not be too sensitive to the change of temperature and the change of supplied voltage.

SUMMARY OF THE INVENTION

Therefore, it is a primary objective of the present invention to provide a bandgap reference circuit to achieve a circuit having a more stable startup circuit. The invention provides a better solution for the bandgap reference circuit and neglects the errors caused by the resistors, so that the output voltage has a lower sensitivity to the change of temperature and the change of supplied voltage.

The bandgap reference circuit of the invention comprises:

a first amplifier and a second amplifier, and an input terminal of the second amplifier is coupled to an input terminal of the first amplifier, and the circuit comprises a first bipolar junction transistor and a second bipolar junction transistor connected to different transistors, and the emitter of the first bipolar junction transistor is electrically connected to the drain of the first metal oxide semiconductor, and the emitter of the second bipolar junction transistors is electrically connected to the drain of the second metal oxide semiconductor through the resistor, wherein the emitter area of the bipolar junction transistor is an integer multiple of the emitter area of the first bipolar junction transistor.

The circuit further comprises a first metal oxide semiconductor having its drain electrically connected to an emitter of the first bipolar junction transistor, and a drain of the second metal oxide semiconductor is electrically connected to an emitter of the second bipolar junction transistor. The drain of the second metal oxide semiconductor is electrically connected to a resistor for correcting its voltage.

The reference circuit further includes a third metal oxide semiconductor and a compensation circuit electrically connected to a source of a fifth metal oxide semiconductor, and jointly and electrically connected to a supplied power, and the drains of the fifth metal oxide semiconductor and the third metal oxide semiconductor are jointly and electrically connected to a reference voltage Vref, and grounded through a resistor.

The reference circuit further includes a fourth metal oxide semiconductor having its drain electrically connected to an input terminal of the second amplifier and grounded through a resistor.

The plurality of metal oxide semiconductor gates are electrically connected to an output terminal of the first amplifier, and the sources are jointly and electrically connected to the supplied power to provide equal drain currents, and the bandgap reference circuit outputs a stable startup voltage having a low sensitivity to the change of temperature and supplied voltage.

DETAILED DESCRIPTION OF PREFERRED EMBODIMENTS

To make it easier for our examiner to understand the innovative features and technical content, we use a preferred embodiment together with the attached drawings for the detailed description of the invention, but it should be pointed out that the attached drawings are provided for reference and description but not for limiting the present invention.

Figure 1:
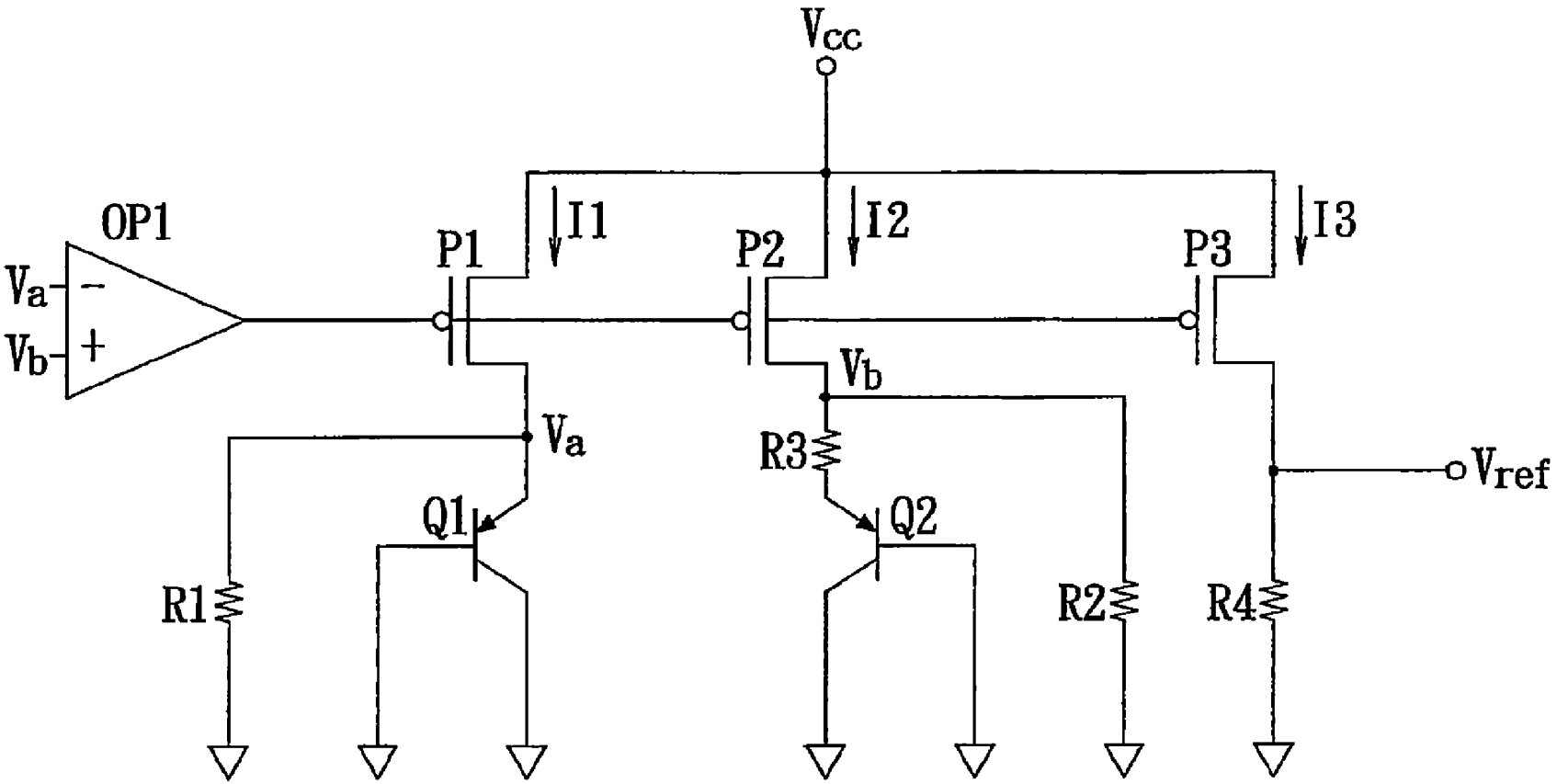
FIG. 1 PRIOR ART
FIG. 1 is a schematic view of a prior art bandgap reference circuit.
Figure 2:
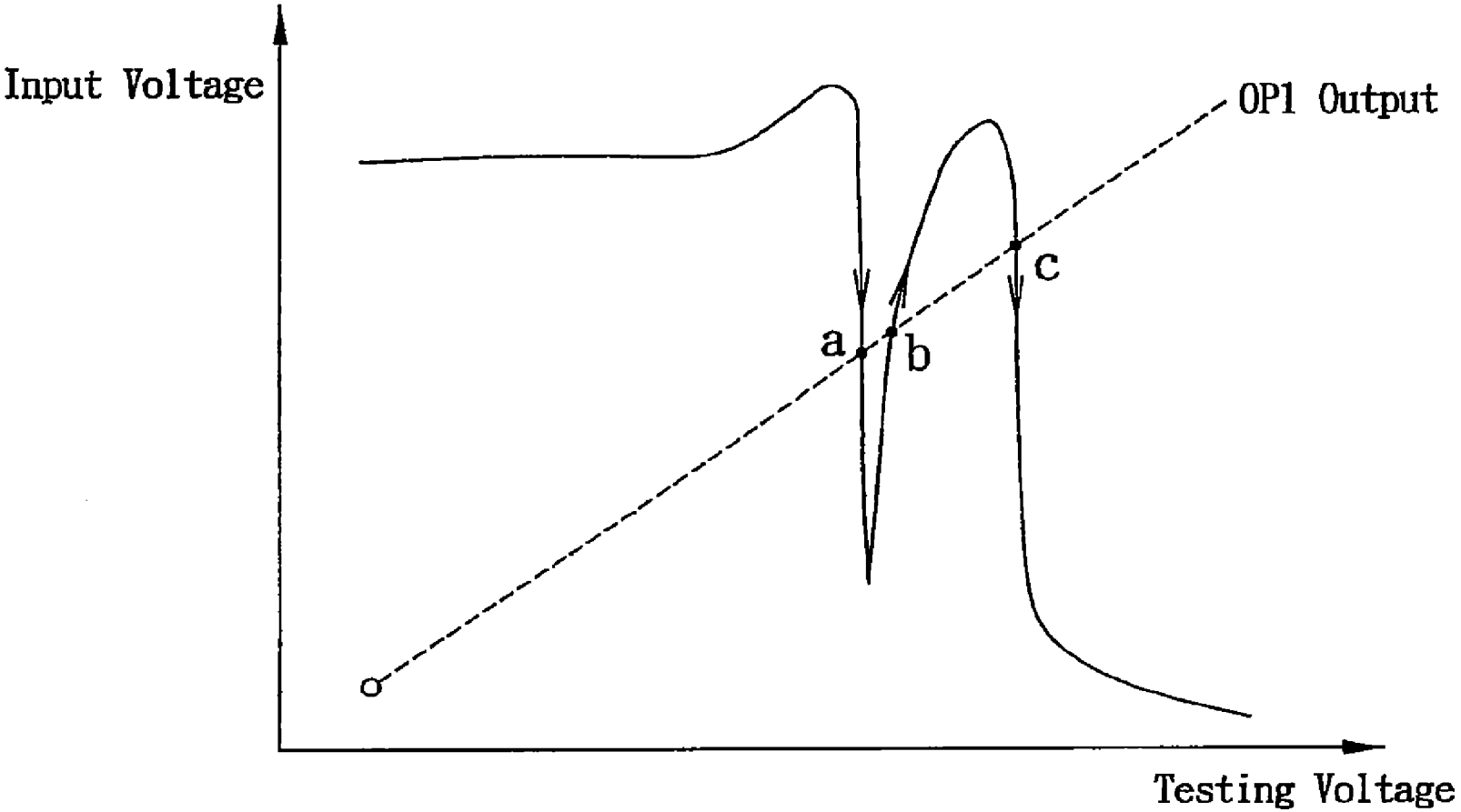
FIG. 2 PRIOR ART
FIG. 2 is an output voltage testing waveform diagram of a prior art operational amplifier.
Figure 3:
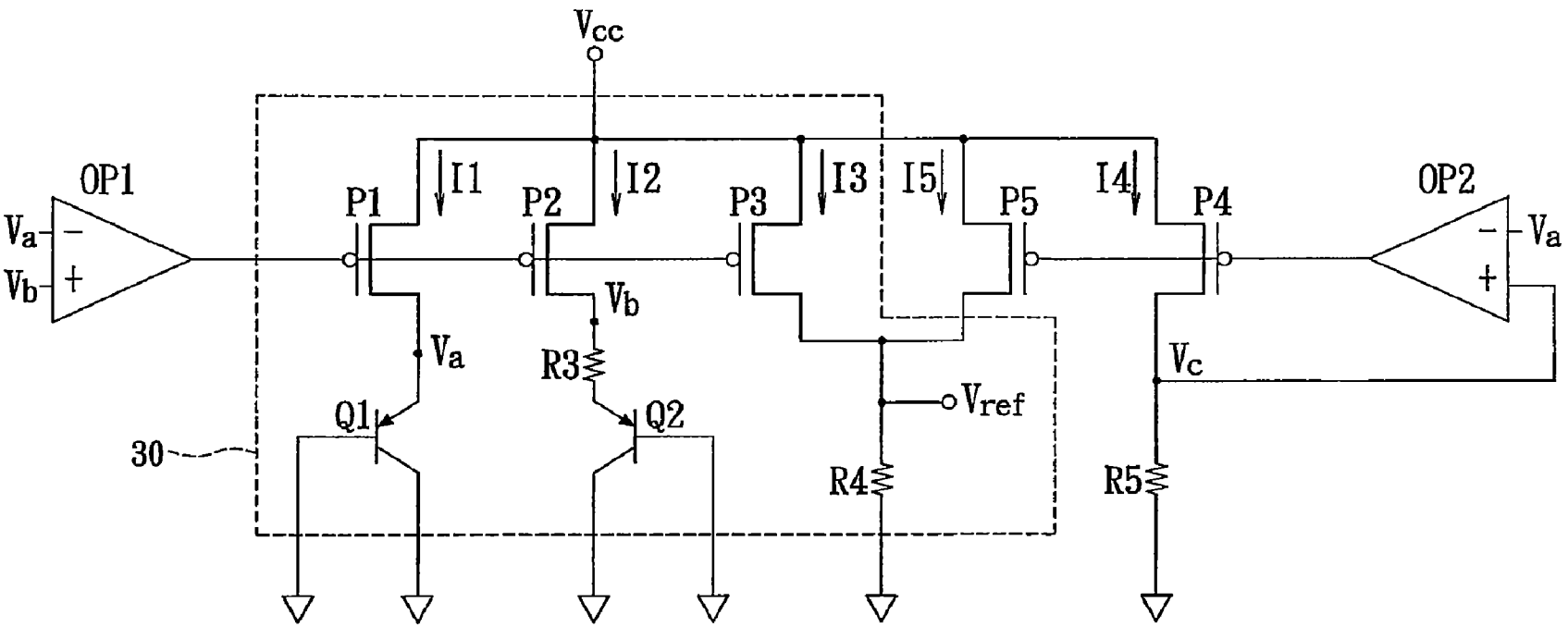
FIG. 3 is a schematic view of a bandgap reference circuit according to a preferred embodiment of the present invention.

To make the output voltage of a bandgap reference circuit to have a low sensitivity to the change of temperature and supplied voltage, a bandgap reference circuit according to a preferred embodiment of the present invention as shown in FIG. 3 is provided. Compared with the prior art as shown in FIG. 1, the present invention neglects the resistor R1 and R2 and adds two P-type metal oxide semiconductor P4, P5, a second amplifier OP2, and a resistor R5, and the emitter area of the PNP bipolar junction transistors Q2 is an integer multiple N of the emitter area of the transistor Q1.

A bandgap reference circuit as shown in the figures is described in details below:

The bandgap reference circuit of the invention comprises a first amplifier OP1 and a second amplifier OP2, and an input terminal of the second amplifier OP2 is coupled to an input terminal of the first amplifier, and the inputted voltage Va is shown in the figure.

The bandgap reference circuit of the invention further comprises a first bipolar junction transistor Q1 and a second bipolar junction transistor Q2 connected to different transistors, and the emitter of the first bipolar junction transistors Q1 is electrically connected to the drain of the first metal oxide semiconductor P1, and the collector is connected to a base or grounded, and the emitter of the second bipolar junction transistors Q2 is electrically connected to the drain of the second metal oxide semiconductor P2, and its collector is connected to a base or grounded, wherein the second bipolar junction transistors Q2 has an emitter area equal to an integer multiple of the emitter area of the first bipolar junction transistors.

The bandgap reference circuit of the invention further comprises a first metal oxide semiconductor P1, wherein its drain is electrically connected to the emitter of the first bipolar junction transistors Q1, and the drain of the second metal oxide semiconductor P2 is electrically connected to the emitter of the second bipolar junction transistors Q2, and the drain of the second metal oxide semiconductor P2 is electrically connected to a resistor R3 for correcting its voltage.

The bandgap reference circuit of the invention further comprises a third metal oxide semiconductor P3 connected to the source of a fifth metal oxide semiconductor P5 of the compensation circuit and electrically connected to the supplied power Vcc. The drains of the fifth metal oxide semiconductor P5 and the third metal oxide semiconductor P3 are jointly and electrically connected to a reference voltage terminal Vref and grounded through a resistor R4.

The bandgap reference circuit of the invention further comprises a fourth metal oxide semiconductor P4 with its drain electrically connected to an input terminal of the second amplifier OP2 (which is the voltage Vc of input terminal), and electrically connected to a resistor R5 and then grounded.

The gates of the foregoing metal oxide semiconductors P1, P2, P3 are electrically connected to an output terminal of the first amplifier OP1. For the compensation circuit, the gates of its metal oxide semiconductors P4, P5 are electrically connected to an output terminal of the second amplifier OP2, and the sources of the plurality of metal oxide semiconductors are jointly connected to the supplied power Vcc and the drain is electrically grounded for providing equal drain currents. The output of the bandgap reference circuit having a low sensitivity to the change of temperature and the magnitude of supplied voltage can stably start the voltage.

The P-type metal oxide semiconductors P1, P2, P3 as shown in FIG. 3 are the identical transistors, and their gates are jointly and electrically connected to the first amplifier OP1, and their sources are jointly and electrically connected to a supplied power Vcc and produce equal drain currents I1=I2=I3.

The transistors P4, P5 of the invention are also identical transistors, and the gates of both transistors P4, P5 are jointly and electrically connected to an output terminal of the second amplifier OP2, and the transistor P5 forms a current mirror transistor of the transistor P4, and both drain currents coming from the supplied power are equal (that is I4=I5).

The second amplifier OP2 makes the input voltage Va equal to the voltage Vc, and the voltage Vc makes the current passing through the resistor R5 similar to the prior art current VBE/R5 (where VBE is the base-emitter voltage of the bipolar junction transistors) and thus I4=15=VBE/R5. Since the voltage Va is equal to the voltage Vb, the current passing through the resistor R3 forms a PTAT current which varies directly with the absolute temperature, and the base-emitter voltage VBE varies inversely with the absolute temperature. Therefore, this current equals to VT·1 nN/R3 as derived below:

The bipolar junction transistor Q2 has an emitter area equal to an integer multiple N of the emitter area of the transistor Q1, and Is is a supplied voltage, and the base-emitter voltage of the transistor is VBE. Therefore, the drain currents I1 and I2 are given below:

$$I1=Is\cdot e^{VBE1/VT}$$

$$I2=N\cdot Is\cdot e^{VBE2/VT}$$

Therefore, $$V_{BE1}=VT\cdot 1\ n(I1/Is)$$

$$V_{BE2}=VT\cdot 1\ n(I2/(N\cdot Is))$$

Since I1=I2 and Va=VBE1=Vb=VBE2+dVf dVf is the voltage different between Va and Vb, therefore $$VT\cdot 1\ n(I1/Is)=VT\cdot 1\ n(I2/(N\cdot Is))+I2\cdot R3$$

Therefore, I1=I2=I3=VT·1 nN/R3 where, the drain of the transistor P2 is electrically connected to the resistor R3 which can correct its voltage; VT is equal to KT/q; V is the voltage; T is the absolute temperature; N is the ratio of the emitter areas of the bipolar junction transistors Q2 and Q1; K is the Boltzmann constant, and q is the quantity of electric charges (in the unit of Coulomb)

Since the sources of the transistors P3, P5 are jointed connected to the supplied power Vcc, and their drains are jointly and electrically connected to the resistor R4, so that the current passing through the resistor R4 is the sum of the currents I3, I5 passing through the transistors, and the reference voltage is:

$$\begin{aligned} Vref &= R4\cdot(I5+I3) \\ &= R4\cdot((VBE/R5)+(VT\cdot \ln N/R3)) \\ &= (R4/R3)\cdot((VBE\cdot R3/R5)+(VT\cdot \ln N)) \end{aligned}$$

Compared with the prior art, the variables of the reference circuit of the invention include R3, R4 and R5 and omit the resistors R1 and R2, and R1 and R2 should be equal or corresponsive with each other. The prior art reference circuit 30 as shown in the figure includes the transistors Q1, Q2, and uses a compensation circuit to substitute the resistors R1 and R2, and thus there is no particular requirement for resistors R1 and R2. Compared with the prior art, the invention can reduce the error of starting up a circuit caused by manufacturing errors.

Figure 4:
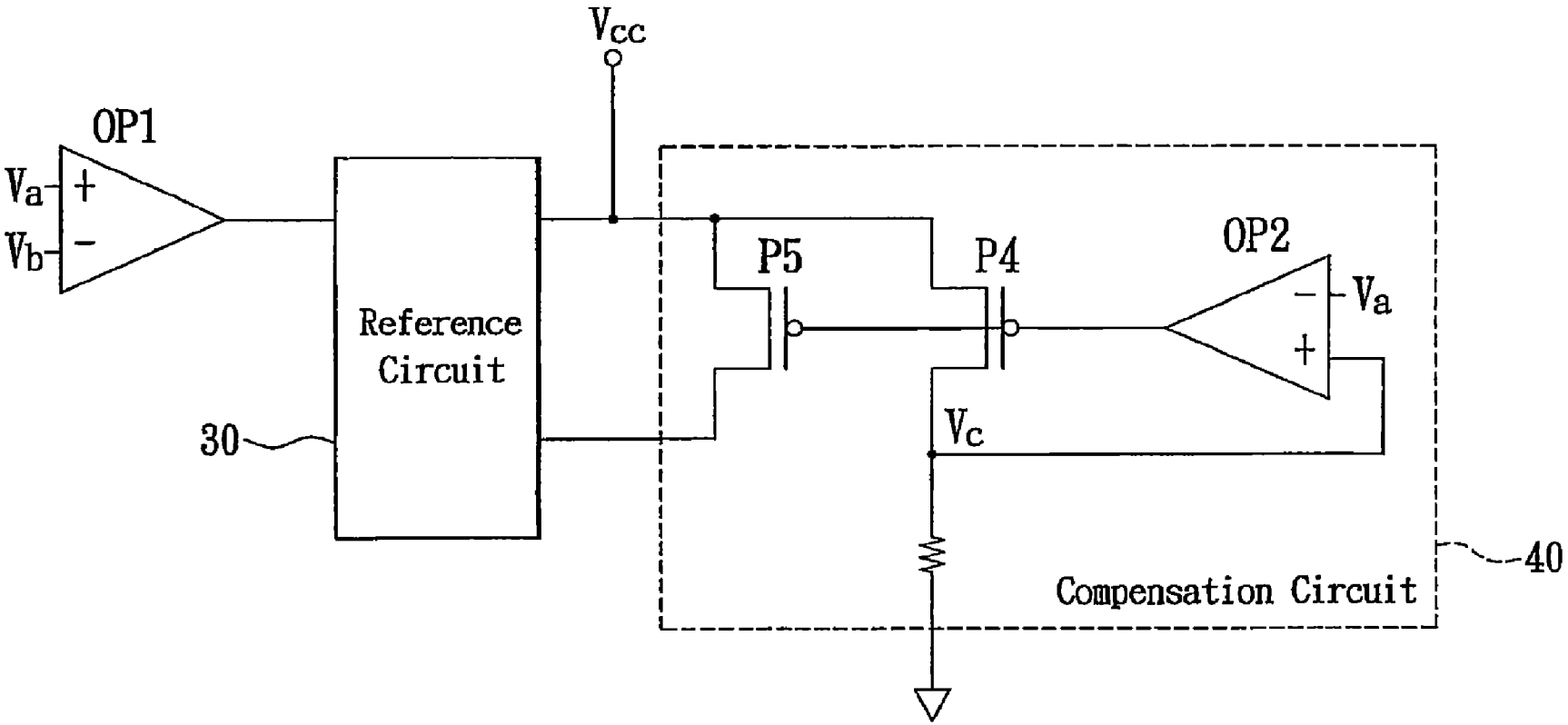
FIG. 4 is a schematic block diagram of a bandgap reference circuit of the present invention.

FIG. 4 shows a block diagram of a bandgap reference circuit according to the present invention, wherein the prior art reference circuit 30 as shown in FIG. 3 removes the resistors taken for the consideration of compatibility and installs a compensation circuit 40 to satisfy the low sensitivity requirements for the temperature and voltage of the bandgap reference circuit according to the present invention. The invention installs the transistors P4 and P5 to form a transistor pair, and their gates are jointly and electrically connected to the output terminal of the second amplifier OP2.

Figure 5:
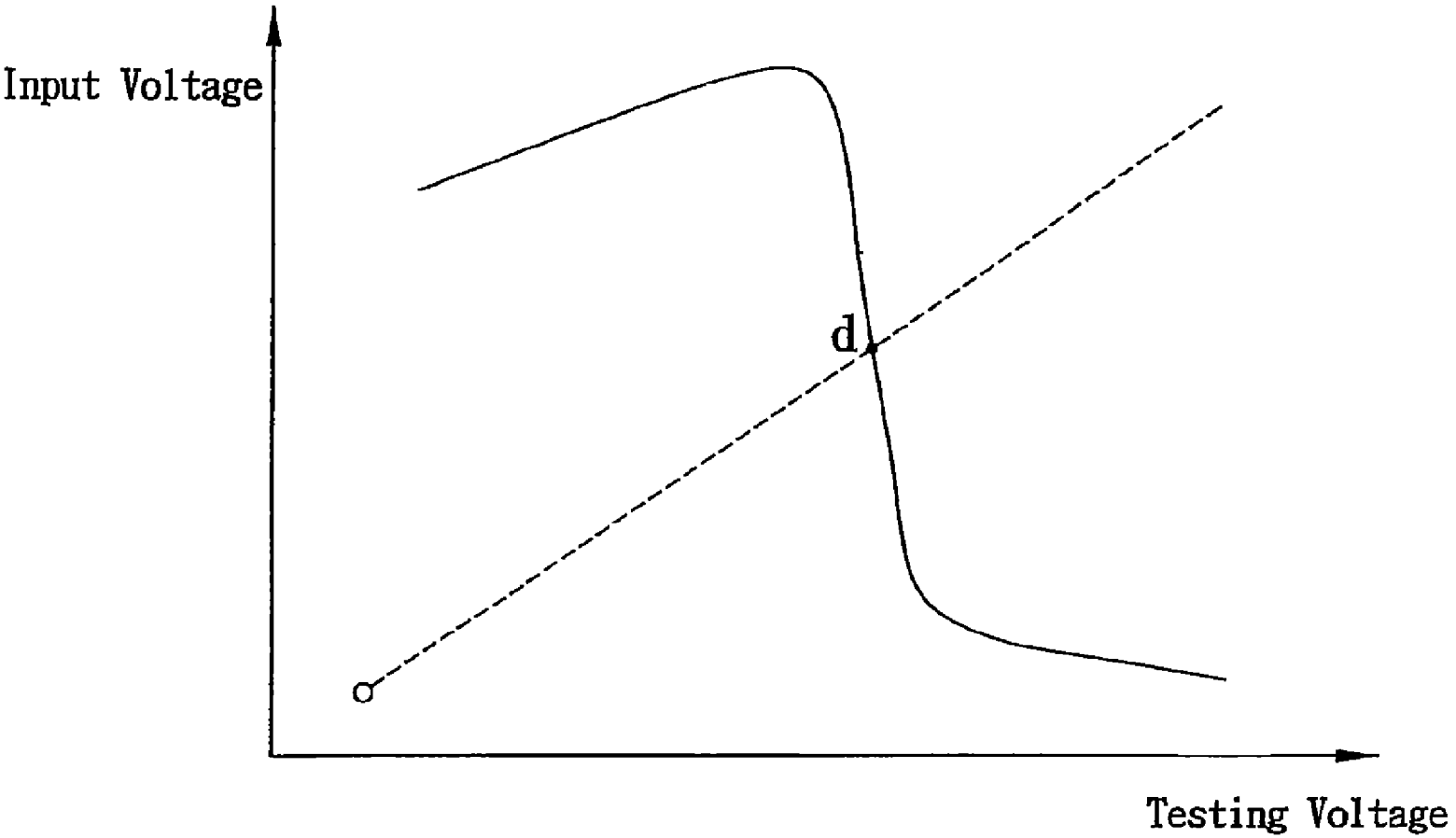
FIG. 5 is an output voltage testing waveform diagram of an operational amplifier of the present invention.

FIG. 5 shows the variation of the inputted voltages after disconnecting the voltage of each of the transistors P1, P2 and P3 connected to the output terminal of the first amplifier OP1. In FIG. 5, there is only one stable voltage (at point d), which can successfully start up the voltage of the circuit.

It is worth to point out that the bandgap reference circuit of the present invention can adopt one resistor R1 for the resistor R5 of this preferred embodiment, and thus the problem of having a deviation between the resistors R1, R2 caused by the semiconductor manufacturing process will not occur.

Although the present invention has been described with reference to the preferred embodiments thereof, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A bandgap circuit, comprising:

a first amplifier;

a second amplifier;

a reference circuit, being electrically connected to an output terminal of the first amplifier and including:

a first metal oxide semiconductor having a gate, a source, and a drain, the first metal oxide semiconductor connected to the output terminal of the first amplifier, a second metal oxide semiconductor having a gate, a source, and a drain, the second metal oxide semiconductor connected to the output terminal of the first amplifier, and the drain of the second metal oxide semiconductor electrically connected to a first resistor for correcting the voltage of the drain of the second metal oxide semiconductor, a third metal oxide semiconductor having a gate, a source, and a drain, the third metal oxide semiconductor connected to the output terminal of the first amplifier, a first bipolar junction transistor having a base, a collector, and an emitter, the first bipolar junction transistor electrically connected to the drain of the first metal oxide semiconductor, and a second bipolar junction transistor having a base, a collector, and an emitter, said second bipolar junction transistor electrically connected to the drain of the second metal oxide semiconductor via the first resistor, wherein the current through the first resistor is a proportional-to-absolute-temperature (PTAT) current that is proportional to the natural logarithm of N/R, where N is the ratio between the area of the emitter associated with the first bipolar junction transistor and the area of the emitter associated with the second bipolar junction transistor, and where R is the resistance of the first resistor, and wherein the source of each of the metal oxide semiconductors is jointly and electrically connected to a power supply and each of the metal oxide semiconductors providing equal drain currents; and a compensation circuit, electrically connected to the power supply to which each of the metal oxide semiconductors is electrically connected, and including a plurality of transistors and the second amplifier, wherein the gates of the plurality of transistors are jointly connected to the output terminal of the second amplifier, and wherein the first amplifier provides an input to the second amplifier, whereby the reference circuit outputs a stable startup voltage that has a low sensitivity to a change of temperature and a change of supplied voltage.

2. The bandgap circuit of claim 1, wherein the emitter of the first bipolar junction transistor is electrically connected to the drain of the first metal oxide semiconductor, and the collector and the base are grounded.

3. The bandgap circuit of claim 1, wherein the emitter of the second bipolar junction transistor is electrically connected to the drain of the second metal oxide semiconductor, and the collector and the base are grounded.

4. The bandgap circuit of claim 1, wherein the drain of the third metal oxide semiconductor is ground through a second resistor.

5. The bandgap circuit of claim 1, wherein the second bipolar junction transistor has an emitter area equal to an integer multiple of the emitter area of the first bipolar junction transistor.

6. The bandgap circuit of claim 1, wherein the compensation circuit further comprises:

a fourth metal oxide semiconductor having a gate, a source, and a drain, the gate of the fourth metal oxide semiconductor electrically connected to the output terminal of the second amplifier; and a fifth metal oxide semiconductor having a gate, a source, and a drain, the gate of the fifth metal oxide semiconductor electrically connected to the output terminal of the second amplifier, and the drain of the fifth metal oxide semiconductor connected to the drain of the third metal oxide semiconductor of the reference circuit, wherein each of the source of the fourth and the fifth metal oxide semiconductors is jointly and electrically connected to the power supply to provide equal drain currents.

7. The bandgap circuit of claim 6, wherein the drain of the fourth metal oxide semiconductor is electrically connected to an input terminal of the second amplifier and electrically connected to a third resistor and then grounded.

8. The bandgap circuit of claim 6, wherein the drain of the fifth metal oxide semiconductor is grounded through a fourth resistor.

* * * * *